US007238047B2

(12) United States Patent
Saettele et al.

(10) Patent No.: US 7,238,047 B2
(45) Date of Patent: Jul. 3, 2007

(54) CONNECTOR PLUG AND MATING PLUG

(75) Inventors: Fred Saettele, Loeffingen-Unadingen (DE); Roland Baumgaertner, Bonndorf-Wellendingen (DE)

(73) Assignee: IMS Connector Systems GmbH, Loeffingen (DE)

( * ) Notice: Subject to any disclaimer, the term of this patent is extended or adjusted under 35 U.S.C. 154(b) by 0 days.

(21) Appl. No.: 11/488,125

(22) Filed: Jul. 18, 2006

(65) Prior Publication Data

US 2007/0020973 A1 Jan. 25, 2007

(30) Foreign Application Priority Data

Jul. 20, 2005 (DE) ..... 10 2005 034 497

(51) Int. Cl.
*H01R 9/05* (2006.01)

(52) U.S. Cl. ..... 439/578; 439/253

(58) Field of Classification Search ..... 439/578, 439/253–257, 350–354, 357, 358
See application file for complete search history.

(56) References Cited

U.S. PATENT DOCUMENTS 4,377,320 A 3/1983 Lathrop et al.
4,533,194 A * 8/1985 Boichut et al. ..... 439/347
4,979,765 A * 12/1990 Bartholomew ..... 285/93
5,161,834 A * 11/1992 Norkey ..... 285/319

(Continued)

FOREIGN PATENT DOCUMENTS

DE 44 39 852 C2 5/1996

(Continued)

*Primary Examiner*—Ross N. Gushi
(74) *Attorney, Agent, or Firm*—The Nath Law Group; Jerald L. Meyer; Derek Richmond

(57) ABSTRACT

The invention concerns a coaxial connector plug and mating plug in which the connector plug has a connector housing that is open at the front end for plugging in the mating plug and contains a canal holding an insulated internal conductor contact, with a clamp sleeve and a sliding sleeve that can be moved axially to mechanically connect the connector housing with the mating plug, wherein the sliding sleeve surrounds the clamp sleeve in the operating position and exerts on it a force directed radially inward in the operating position, and wherein the clamp sleeve can be made to rest against the mating plug at a clamp surface, and wherein an outer conductor contact surface of the mating plug can be clamped axially against an outer conductor contact surface of the connector plug. The purpose of the invention is to create a connector plug of the sort described above, where an outer conductor contact surface of the mating plug can be axially clamped against an outer conductor contact surface of the connector plug, independent of the shape of the clamp surface, in other words, even if the clamp surface is perpendicular to the longitudinal axis of the mating plug. This purpose is achieved in that the clamp sleeve (8) has an end section (15) with a part (15*a*) extending diagonally outward followed by a part (15*b*) extending diagonally inward and backward, wherein an axial force component ($F_a$) is exerted in the operating position by the clamp sleeve (8) on the clamp surface (13) via the part (15*b*) extending backward and in that the clamp sleeve (8) has a widening part (12) between the connector plug and the end section (15) followed by a narrowing part (12*a*).

24 Claims, 4 Drawing Sheets

Figure 1:
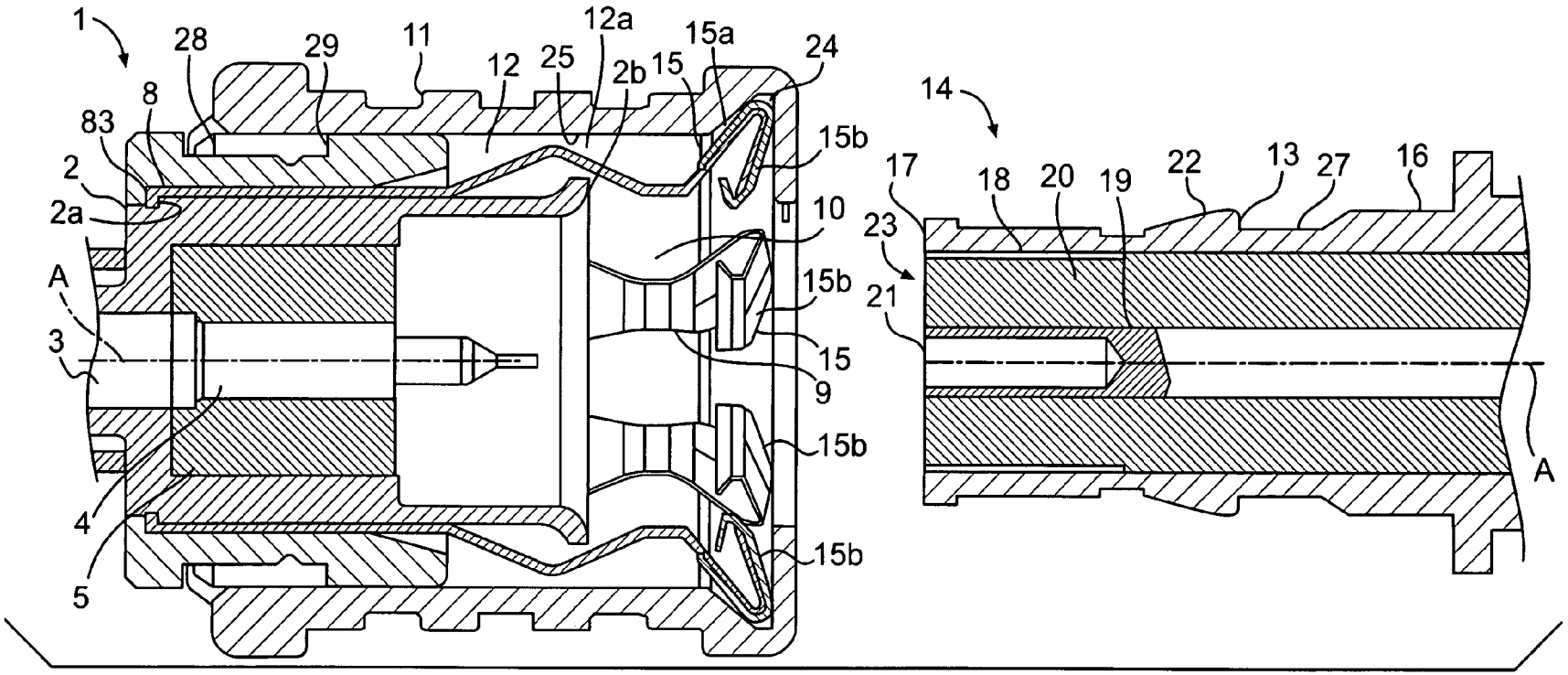

U.S. PATENT DOCUMENTS 5,228,728 A * 7/1993 McNaughton et al. ..... 285/319
5,257,833 A * 11/1993 McNaughton et al. ..... 285/319
5,318,457 A * 6/1994 Harting et al. ..... 439/352
5,368,275 A * 11/1994 Ketcham et al. ..... 251/149.6
5,378,025 A * 1/1995 Szabo ..... 285/39
5,486,025 A * 1/1996 Ketcham ..... 285/319
5,518,276 A * 5/1996 Gunderson ..... 285/93
5,542,717 A * 8/1996 Rea et al. ..... 285/319
5,573,279 A * 11/1996 Rea et al. ..... 285/21.1
5,595,499 A * 1/1997 Zander et al. ..... 439/352
5,637,010 A * 6/1997 Jost et al. ..... 439/352
5,785,545 A * 7/1998 Holt ..... 439/352
5,992,903 A * 11/1999 Bartholomew ..... 285/319
5,997,333 A * 12/1999 Konda et al. ..... 439/352
6,142,812 A * 11/2000 Hwang ..... 439/352
6,267,612 B1 * 7/2001 Arcykiewicz et al. ..... 439/253
6,343,814 B1 * 2/2002 Bucher et al. ..... 285/319
6,464,527 B2 * 10/2002 Volpe et al. ..... 439/352
6,645,011 B2 * 11/2003 Schneider et al. ..... 439/609
6,692,286 B1 * 2/2004 De Cet ..... 439/352
6,695,636 B2 * 2/2004 Hall et al. ..... 439/352
6,709,289 B2 * 3/2004 Huber et al. ..... 439/578
6,866,304 B2 * 3/2005 Kaminski et al. ..... 285/319
6,884,105 B2 * 4/2005 Turck et al. ..... 439/352
6,910,910 B2 * 6/2005 Cairns ..... 439/352
7,189,113 B2 * 3/2007 Sattele et al. ..... 439/578
2004/0014350 A1 * 1/2004 McMullen et al. ..... 439/350

FOREIGN PATENT DOCUMENTS

EP 1 222 717 B1 7/2002
EP 1 337 008 A2 8/2003

* cited by examiner

CONNECTOR PLUG AND MATING PLUG

DESCRIPTION

As per the characterizing clause given in Patent Claim 1, this is an invention of a coaxial connector plug and corresponding mating plug. A similar connector plug—mating plug combination is already known, for example, from EP 1 222 717 B1. In the known connector plug, a radial force is applied to the mating plug via a radially pre-stressed clamp sleeve. This applied radial force is converted to an axial force component via a surrounding clamp surface inclined towards the longitudinal axis of the mating plug. The known connector-mating plug combination therefore always requires a clamp surface inclined towards the longitudinal axis of the mating plug in order to convert the force applied radially to an axial force component.

The purpose of the invention is to create a connector plug of the sort described above, where an outer conductor contact surface of the mating plug can be axially clamped against an outer conductor contact surface of the connector plug, independent of the shape of the clamp surface, in other words even if the clamp surface is perpendicular to the longitudinal axis of the mating plug.

This purpose is achieved with the characteristics described in Patent Claim 1.

Advantageous embodiments of the invention are set forth in the subordinate claims.

The invention is based on the idea of applying the axial force component directly from the clamp sleeve to the clamp surface of the mating plug without first applying a radial force, which then would have to be converted at the clamp surface to an axial force component.

Preference is thereby given to a coaxial connector plug and mating plug in which the connector plug has a connector housing that is open at the front end for plugging in or attaching the mating plug and is traversed by a canal holding an insulated internal conductor contact, with a clamp sleeve and a sliding sleeve that can be moved axially to mechanically connect the connector plug with the mating plug, wherein the sliding sleeve surrounds the clamp sleeve in the operating position and exerts on it a force directed radially inward, wherein a clamp sleeve can be made to rest against the mating plug at a clamp surface, wherein an outer conductor contact surface of the mating plug can be clamped axially against an outer conductor contact surface of the connector plug, wherein the clamp sleeve has an end section with a part extending diagonally outward followed by a part extending diagonally inward and backward, wherein in the operating position an axial force component is applied via the backward extending part from the clamp sleeve to the clamp surface and the clamp sleeve between the connector plug and the end section has a part that first widens and then narrows.

Of particular preference is a coaxial connector plug and mating plug in which the widening part and the narrowing part of the clamp sleeve are designed elastically with spring activation that allows them to stretch temporarily in the axial direction when moving from the stand-by position to the operating position.

Also of particular preference is a coaxial connector plug and mating plug in which the widening part and/or narrowing part between the connector plug and the end section is designed in the form of snap-in pins narrowing diagonally to the longitudinal extension.

Also of particular preference is a coaxial connector plug and mating plug in which the backward extending part of the end section runs either parallel or at an acute angle diagonally backward to the clamp surface.

Of particular preference is also a coaxial connector plug and mating plug in which the clamp surface extends either perpendicular or at an inclination to the outside and to the mating plug.

Of particular preference is also a coaxial connector plug and mating plug which has lugs on the clamp sleeve opposite the end section that are bent in the radial direction and act as a rear stop for the connector housing of the connector plug.

Of particular preference is also a coaxial connector plug and mating plug in which the end section of the clamp sleeve is designed as a snap-in pin with a spherical or spoon-shaped contact head.

Of particular preference is also a coaxial connector plug and mating plug whose contact head is widened by lateral lugs in relation to the normal width of the snap-in pin.

Of particular preference is also a coaxial connector plug and mating plug in which the contact head extends to the full radius of the part extending outward and the part of the end section extending diagonally inward and backward.

Of particular preference is also a coaxial connector plug and mating plug in which the contact head of the end section forms a crease or buckle line on the inside of the end section.

Of particular preference is also a coaxial connector plug and mating plug in which the force applied to the clamp sleeve in the operating position is converted by the clamp sleeve to an axial force component that is applied from the clamp sleeve directly to the clamp surface.

Of preference is also an independent clamp sleeve for rigging such a coaxial connector plug and mating plug, in which the clamp sleeve has an end section with a first part extending diagonally outward followed by a second part extending diagonally inward and backward, wherein an axial force component is applied in the operating position from the clamp sleeve to the clamp surface via the part extending backward and the clamp sleeve has a widening area between the connector plug and the end section followed by a narrowing part.

Since the axial force component is applied to the clamp surface directly by the clamp sleeve itself, i.e., because of the shape of the clamp sleeve, a rechanneling of force either at or in the clamp surface is not necessary, so that the clamp surface can, if necessary, be even perpendicular to the longitudinal axis of the mating plug. Because of this invention, it is no longer necessary to design the clamp surface in such a way that it is inclined to the longitudinal axis of the mating plug.

An advantage of the design of the invention is that a radial force component is also applied from the clamp sleeve directly, i.e., directly by the clamp sleeve, to a compensating surface of the mating plug. In this way, all radial force components acting on the mating plug are compensated, with the result that, even if the clamp surface is inclined, only one axial force component is applied to it.

In a preferred embodiment, the axial force component is applied from the clamp sleeve to the clamp surface only when the sliding sleeve is moved into the operating position. This means that the axial force component is not transferred automatically from the clamp sleeve to the clamp surface after the connector plug and the mating plug are connected. For this to happen, the sliding sleeve must first be moved into the operating position which then exerts a radial force to the clamp sleeve. This presses the free end of the clamp sleeve axially in the direction of the clamp surface, in the process of which an axial force component is applied by the clamp sleeve to the mating plug. In a preferred embodiment of the invention, the clamp sleeve is first at a distance from the clamp surface after the connector and the mating plug are connected and is moved in the direction of the clamp surface only after the sliding sleeve is moved to the operating position and clamped in axial direction against the clamp surface.

In a further preferred embodiment, the radial force component is applied to the compensating surface only by moving the sliding sleeve into the operating position. In the process, the clamp sleeve is first at a distance from the compensating surface and is moved radially against the compensating surface only after moving the sliding sleeve to the operating position.

It is, of course, also conceivable that the clamp sleeve is already pre-stressed in the radial direction in such a way that a radial force component is already applied directly to the compensating surface of the counterpart when the sliding sleeve is still in the stand-by position and has not yet been moved to the operating position.

In a preferred variant of the embodiment, the clamp surface is perpendicular to the longitudinal axis of the mating plug. A preferred design of the invention provides that the clamp surface is located on a ridge of the mating plug protruding radially outward and/or an indent of the mating plug pointing radially inward. In this set-up, it is an advantage if the clamp surface and/or the compensating surface are designed such that they surround the mating plug.

In a preferred embodiment of the invention, the clamp sleeve is designed in such a way that it extends from the connector plug or the front-end opening of the connector plug along the axis past the clamp surface of the mating plug, with the end part being angled or bent back in the direction of the clamp surface. In the process, the end part of the clamp sleeve extends in particular in an acute angle to the longitudinal axis of the mating plug. In order to improve the clamping force along the axis, the clamp sleeve preferably has an area widening radially outward and is located preferably directly next to the bent end part.

To facilitate the radial movement of the clamp sleeve, the clamp sleeve has axially extending slits forming snap-in pins. The snap-in pins are connected to each other at one end by a surrounding ring section. As an alternative, the clamp sleeve consists of tension springs separated from each other, distributed over the circumference of the connector and extending along the axis.

The sliding sleeve preferably also surrounds the clamp sleeve, even in the stand-by mode, during which the clamp sleeve exerts no axial force on the clamp surface. The sliding sleeve may also be moved axially between the stand-by position and the operating position. Normally the sliding sleeve is designed in such a way that a radial force, albeit small, is exerted on the clamp sleeve even in the stand-by mode. The radial force exerted by the sliding sleeve on the clamp sleeve is, however, only large enough in the working position for the clamp sleeve to exert an axial force component on the clamp surface of the mating plug.

Of course, the sliding sleeve may be designed also in such a way that the sliding sleeve in the stand-by position does not exert any force on the clamp sleeve.

It is preferred if the clamp sleeve fits with its radially outermost, in particular its front-end area, into an indent on the inner circumference of the sliding sleeve circumference. The indent preferably has a radially narrowing axial section, making it easy to move the sliding sleeve from the stand-by position to the operating position.

Figure 2:
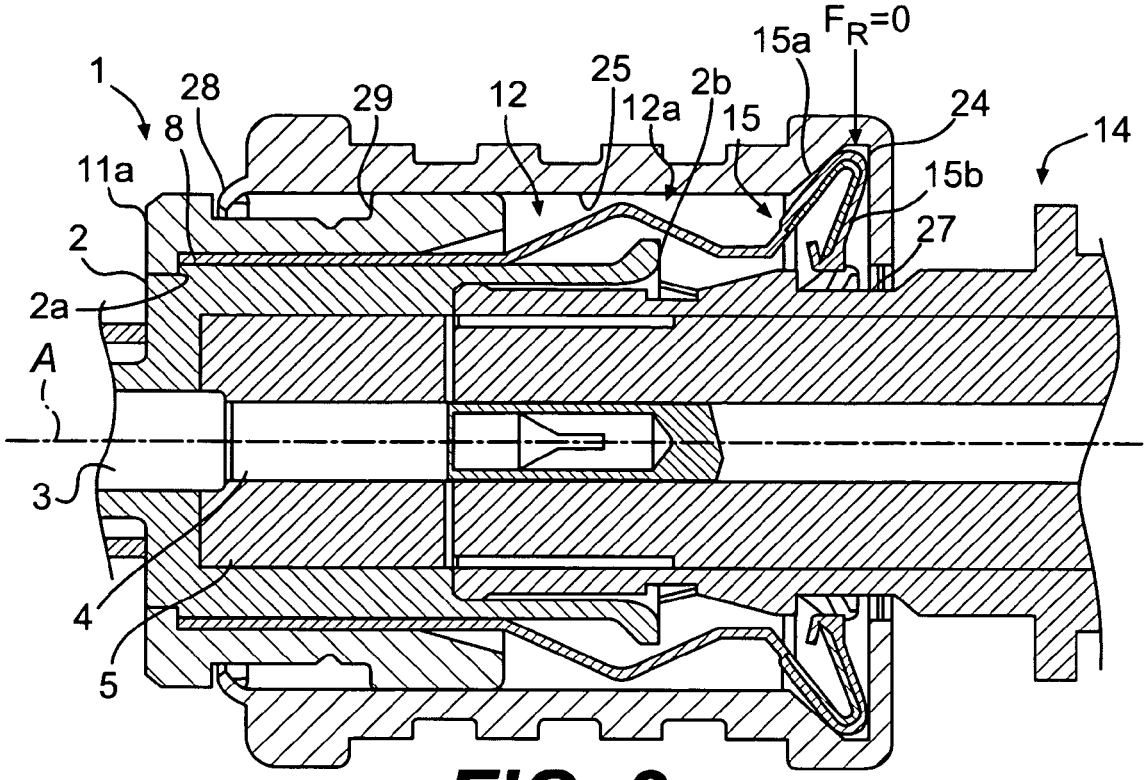
Figure 3:
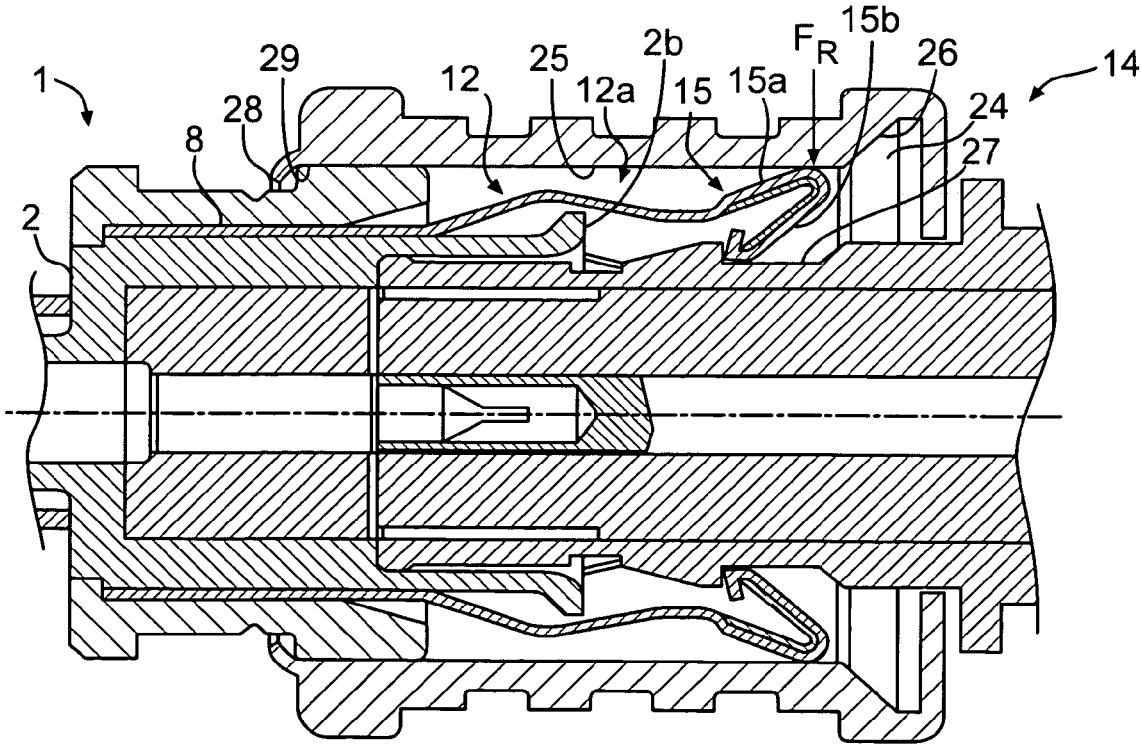
Figure 4A:
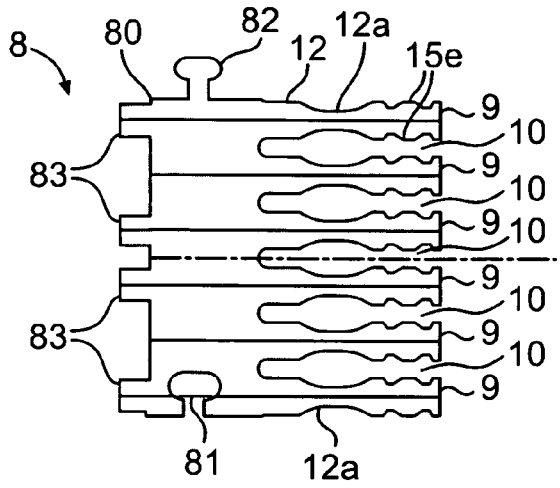
Figure 4B:
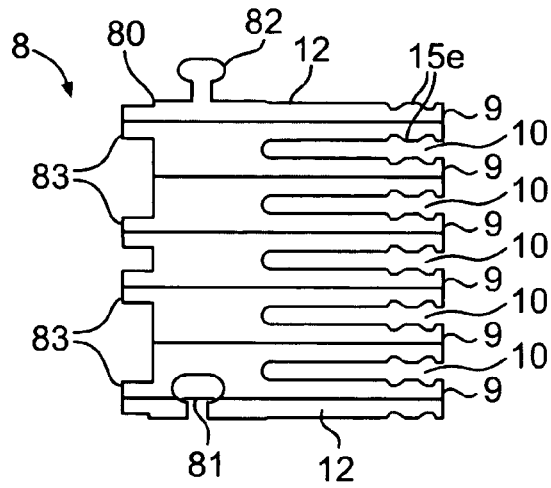
Figure 5:
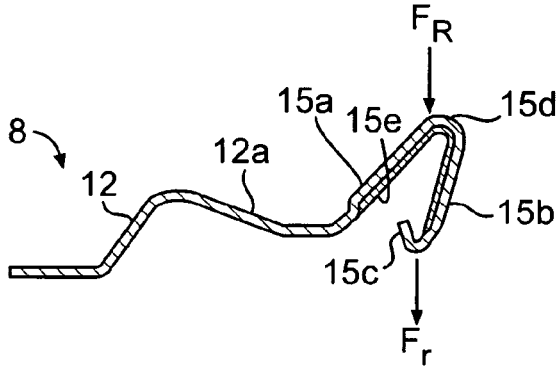
Figure 7:
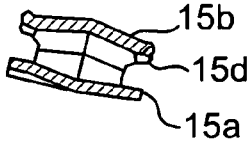
Figure 8:
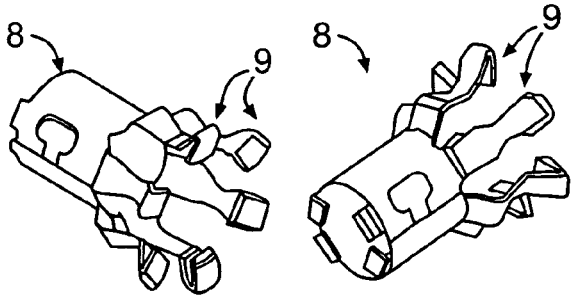
Figure 6A:
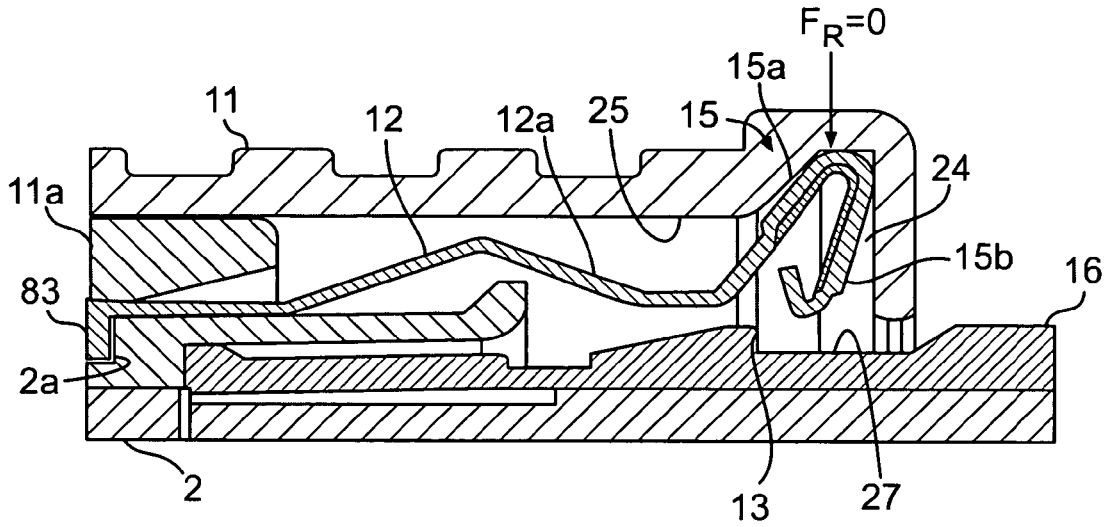
Figure 6B:
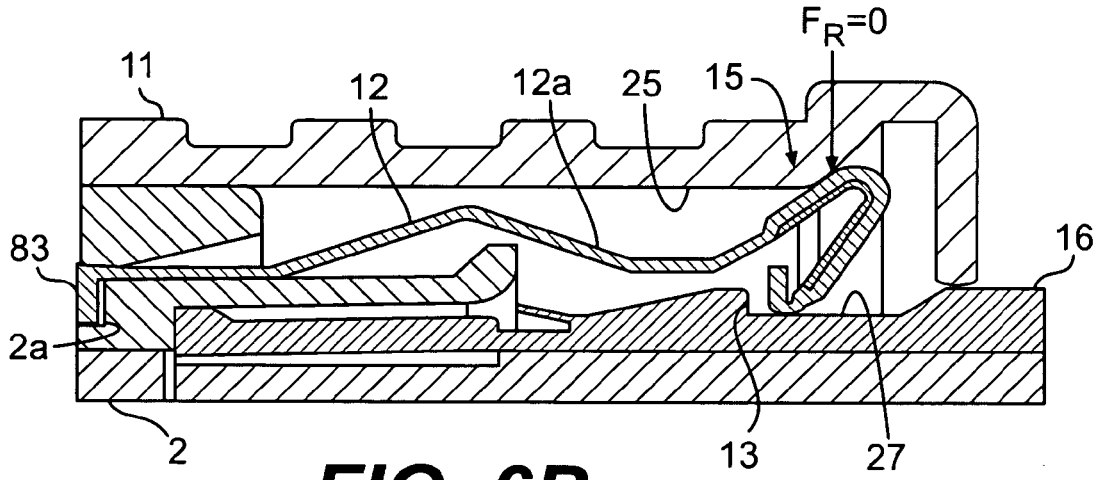
Figure 6C:
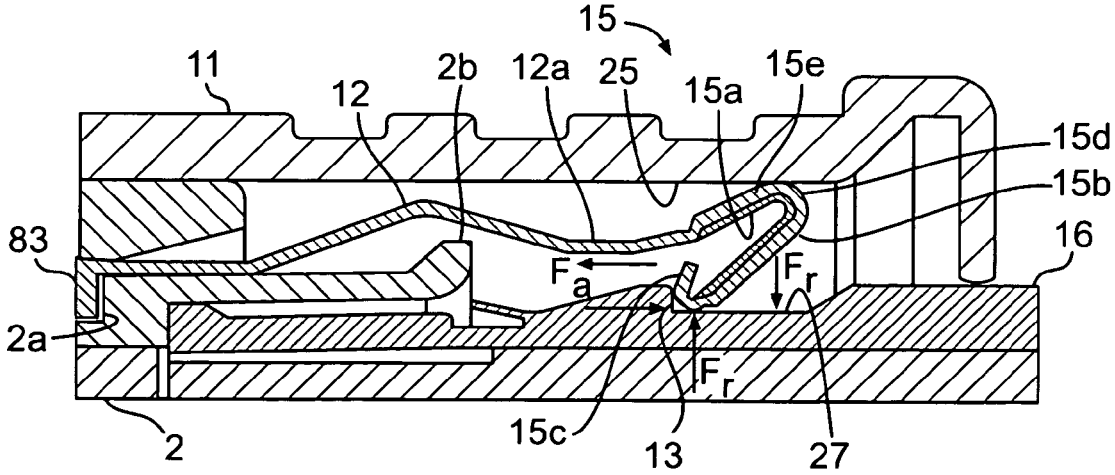

An example of embodiment of the invention is explained in more detail below with the help of illustrations as follows:

FIG. 1 shows a section through a connector plug according to the invention, as well as a section through a mating plug separated from the connector plug, FIG. 2 shows a section through the connector plug with the plugged-in mating plug and with the sliding sleeve in the stand-by position, FIG. 3 shows a section through the connector plug with the plugged-in mating plug and with the sliding sleeve in the operating position, FIG. 4A shows a schematic enlargement of a rolled and punched metal sheet for manufacturing the clamp sleeve for such a connector plug, FIG. 4B shows a schematic enlargement of an alternative rolled and punched metal sheet for manufacturing the clamp sleeve for such a connector plug, FIG. 5 shows a section through the clamp sleeve and a front-end snap-in pin of the clamp sleeve in the unstressed, bent state of the stand-by position, FIG. 6A shows a section through such a clamp sleeve with the snap-in pin and the components of the connector plug and mating plug surrounding it, in an operating position that does not stress the snap-in pin, FIG. 6B shows a section in an operating position partially stressing the snap-in pin, FIG. 6C shows a section in an operating position stressing the snap-in pin, FIG. 7 shows a partial section through an end portion of the snap-in pin and FIG. 8 shows two perspective views of a clamp sleeve with a multitude of front-end snap-in pins.

FIG. 1 shows, on the left, a connector plug 1 with a front end open in the illustration on the right side, as well as a mating plug 14 for plugging into the connector plug 1 arranged along a longitudinal axis A. For simplicity's sake, the elements of the connector plug 1 that are turned toward the mating plug 14 are described as being located on the front of the connector plug 1 and elements of the connector 1 arranged on the side of the connector 1 turned away from the mating plug 14 are described as located on the back. By the same token, elements of the mating plug 14 turned toward the connector plug 1 are described as being at the front of the mating plug 14. A clamp sleeve 8 is described as allocated to the connector plug 1 only by way of example. The respective components of the connector plug 1 and the mating plug 14 are mutually exchangeable, in particular with regard to the plug and socket function.

The coaxial connector plug 1 has a connector housing 2 that is open in front and is traversed by a canal 3. An interior conductor contact 4 is located in the canal 3 and is insulated from the connector housing 2 via a sleeve-shaped insulator 5. The connector housing 2 forms an outer conductor and has a ring-shaped, circumferential outer conductor surface 6 in the opening in front. The insulating sleeve as insulator 5 is preferably flush in front with the outer conductor surface 6 or indented relative to it.

The clamp sleeve 8 that protrudes in the axial direction and is inserted and, in particular, pressed firmly radially into the opening 7, is attached within the front-end opening of the connector plug 1. The clamp sleeve 8 has axial slits 10 at the front-end forming several elastic spring-activated snap-in pins 9.

FIG. 4A shows a surface arc made of an electrically conductive material whose front end is bent into the desired contour in subsequent processing steps before the arc is rolled into a sleeve. An indent 81 with a narrow neck is worked into a side wall in the area of a continuous surface section on the back 80.

In the opposing side area of the back section 80 there is a lug 82 with a contour matching the indent 81, with the result that a lug 82 fits into the indent 81 after being rolled together in order to maintain the arc in the form of a sleeve. On the back of the back section 80, stop tabs 83, which are bent preferably by 90° in an inside radial direction, form lugs in order to form an end stop in the mounted state for the respective opposing end stop 2*a* at a backward extending lug or the back wall of the housing 2 of the connector plug 1. One or more such stop tabs 83 thus prevent the clamp sleeve 8 from sliding from the connector plug 1 toward the front, something that could otherwise be prevented in the operating position, when the mating plug 15 is stressed against the connector plug 1 via the clamp sleeve 8, only at great expense, such as by firmly connecting laterally or pressing together the clamp sleeve 8 and the housing 2.

There is a sliding sleeve 11 around the clamp sleeve 8 that can be moved to a limited extent axially. Optionally another sleeve 11*a* can be arranged between the clamp sleeve 8 and the sliding sleeve 11 as a guide for the sliding sleeve 11, which is then movable with regard to the additional sleeve 11*a*. In FIG. 1 and 2 the sliding sleeve 11 is in a stand-by position in which it does not exert any force on the snap-in pins 9.

Elastic spring-activated catches 9 extend in front of the back section 80 which are separated from each other by the axial slits 10. The snap-in pins 9 extend axially and parallel to the longitudinal axis A of the connector plug 1 from a circumferentially closed area. They are followed in front by a part 12 that widens radially and diagonally toward the outside in which the snap-in pins 9 extend in an outside direction and bent away from the central longitudinal axis A. As shown in FIG. 2 and 5, the snap-in pins 9 with their widening part 12 preferably pass in axial direction, in the unstressed state of the snap-in pins 9, i.e., in the stand-by position, at a distance from the clamp surface 13 of the mating plug 14. The widening part 12 is followed by a narrowing part 12*a* that extends again, bent backward, in the axial direction and is shown in FIG. 4A. The snake-like or accordion-like contour makes it easy for the entire snap-in pin 9 to extend elastically when it is put into the operating position. This arrangement also facilitates the formation of an insert opening 2*b* in the front end section of the housing 2, which makes it easier to insert the mating plug 14 into the front opening 7 of the housing. Preferably the narrowing part 12*a* is designed in this section as being narrow and fitted also with regard to the width of the snap-in pins in order to also support the elastic properties. Instead of a single widening part 12 and a single narrowing part 12*a*, it is possible to optionally also design several such parts in sequence. Instead of the narrowing part 12*a*, the snap-in pin can also be designed without taper such as shown in FIG. 4B.

The part 12, 12*a* of the snap-in pins 9 that widens radially outward and then narrows is followed by an end section 15. The end section 15 starts with a part 15*a* extending diagonally outward and slightly forward. This is followed by a part 15*b* of the snap-in pins 9 bent or angled in the direction of the front opening 7. With this bent part 15*b*, the snap-in pins 9 are returned axially in the direction of the clamp surface 13 and also radially in the direction of the longitudinal axis A of the mating plug 14. The bent part 15*b* thus leads backward in the direction of the open connector plug 1. The optional last end piece 15*c* of the snap-in pins 9 is bent again and extends radially outward to form an enlarged contact area on the clamp surface 13.

As can be seen in particular from FIG. 4 to 7, the end section 15 is designed as a spherical or spoon-shaped contact head. This is taken into consideration when punching or otherwise manufacturing the arc for forming the sleeve by providing for the respective lateral lugs 15*e* at the front-end snap-in pins 9 and when distorting their curvature. This leads to a displacement toward the back of the edges with a surface in the area of the end section that at the same time does not tear on the outside and thus to a stiffening of the spring head of the individual spring arms or snap-in pins 9. Such a stiffened head extends preferably to the full radius of the part 15*a* extending on the outside and the angled part 15*b*. Such a particularly preferable embodiment offers advantages both with regard to the stiff docking properties of the end section 15 to the clamp surface 13 and with regard to the stiffness and gliding ability at the lateral compensating or gliding area 27 of the mating plug 14.

Preferably, the sperical or spoon-shaped contact head of the end section 15 is bent in a way that forms a crease or buckle line 15*f* from the inside of the end section 15.

If the clamp sleeve 8 is made of electrically conductive material, which is not absolutely necessary as such, an additional secure electrical connection between the housing 2 of the connector plug 1 and the housing 16 of the mating plug 14 can be supported via the clamp sleeve 8. The mating plug 14 has an outer conductor in the form of a housing 16, which is essentially cylindrical. In front, the housing 16 has a ring-shaped, circumferential outer conductor contact surface 17. In a canal 18 passing through this housing 16, there is an insulator 20, which in turn contains a conductor 19. On the front of conductor 19 is a socket 21 for accommodating the internal conductor contact 4 of the connector plug 1 protruding axially in the direction of the mating plug.

In the example of embodiment shown here, the clamp surface 13 is located on a ridge 22 of the mating plug 14 radially protruding on the outside, with the clamp surface 13 extending orthogonally to the longitudinal axis A of the mating plug 14. However, a clamp surface, inclined backward from the viewpoint of the mating plug 14, can also be used to advantage.

In FIG. 2, the mating plug 14 is plugged into the connector plug 1. For this purpose, the mating plug 14 was pushed with its front end into the clamp sleeve 8 along the axis until the two contact surfaces 6 and 17 touch. During the plug-in procedure, the clamping sleeve 8 is stretched elastically by spring-action in a radial direction at least for a short time in the example of embodiment shown, which is facilitated to great advantage by the snake and accordion-shaped course of the middle section of the clamp sleeve 8, i.e., of the first section of the snap-in pins 9.

Aiming the angled part 15*b* of the end section 15 into a slightly backward axial direction has the result that the mating plug 4 can be inserted easily and the pressure is exerted against the side of the housing 16 of the mating plug 14 forming the compensating surface 27.

The distance between the stops 9 can be measured by moving the mating plug 14 into the position shown in FIG. 2, without the need for radially enlarging the snap-in pins 9. As mentioned, the clamp sliding sleeve 11 in FIG. 2 is in the stand-by position in which it surrounds all snap-in pins. The snap-in pins 9 fit, with their radially outermost, front-end parts 15*d* of the end section 15, into a circumferential indent 24 in the inner circumference 25 of the sliding sleeve 11. The indent 24 has just the right size so that the sliding sleeve 11 does not exert any or only a minimal radial force on the clamp sleeve 8. The indent 24 has an axial section 26 narrowing in the backward and radial direction. In the stand-by mode shown in FIG. 2, the snap-in pins 9 do not touch the clamp surface 13 nor, which is a great advantage, the glide and/or compensating surface 27 of the mating plug 14 extending parallel to the longitudinal axis A of the mating plug 14. The snap-in pins 9 therefore exert no force on the mating plug 14.

FIG. 3 shows the sliding sleeve 11 in its operating position. For this purpose, the sliding sleeve 11 was moved from the retracted stand-by position shown in FIG. 2 toward the front, i.e., axially in the direction of the mating plug 14. The axial movement is restricted by an edge 28 located at the end of the sliding sleeve 11, which is circumferential and points inward. The edge comes to rest on an opposite side 29 of the connector housing 2 that points radially outward.

During the axial movement of the sliding sleeve 11, the axial section 26 is moved along the radially widening axial section 12 of the snap-in pins 9 until the radially outermost part 15*d* of the snap-in pins 9 rests against the inner circumference 25 of the sliding sleeve running parallel to the longitudinal axis A. In this way, the snap-in pins 9 exert an increasing radial force $F^R$ which generates an axial force component $F_a$ in the snap-in pins 9 applied directly, thus immediately, to the clamp surface 13 of the mating plug 14. As can be seen in FIG. 3, the snap-in pins 9 deform in the operating position of the sliding sleeve 11 in such a way that the originally buckle-shaped course of the end section 15 of the snap-in pins 9 is nearly smoothed out.

Of preference is the design in the form of an open sling with a retracting arm in the shape of the bent part 15*b* of the snap-in pins 9. In the operating position in particular, the sliding sleeve 11 exerts pressure on the sling section that is located radially farthest out and has the effect of returning and stressing the bent part 15*b* in a primarily or entirely axial direction against the clamp surface 13.

Of special preference is a design in which the radially outermost part 15*d* of the snap-in pins 9 is designed as a transition area running in the form of an arc from the part 15*a* extending diagonally at the outside and slightly in front to the part 15 of the snap-in pins 9 bent in the direction of the front-side opening 7. This encourages a uniform tilting of the entire end section from a steeper, almost perpendicular position into an inclined position when switching from the stand-by position to the operating position, with the bent part 15*b* of the snap-in pins 9 in the inclined position extending parallel or almost parallel to the compensating surface.

For similar reasons, the transition area between the bent part 15*b* of the snap-in pins 9 and the last end piece 15*c* gliding on the compensating surface during the switch advantageously also takes the shape of an arc.

FIG. 6C shows schematically the force exerted by the operating position shown in FIG. 3 using a snap-in pin 9. As explained, the sliding sleeve 11 in the operating position exerts a radial force $F_R$ in the snap-in pins 9. This creates an axial force component $F_a$ and a radial force component $F_r$ already in the snap-in pin 9.

The axial force component $F_a$ is exerted by the free end pieces 15*c* of the snap-in pins 9 directly on the clamp surface 13 extending preferably perpendicular to the longitudinal axis A of the mating plug 14, where it generates a counterforce $F_a^1$. The radial force component $F_r$ is exerted directly by the free end pieces 15*c* of the snap-in pins 9 on the compensating surface 27 surrounding the mating plug 14 and extending parallel to the longitudinal axis A of the mating plug, where it generates a counterforce or compensating force $F_r'$. Contrary to the embodiment shown schematically in FIG. 4, the free end pieces 15*c* of the snap-in pins 9 can of course also rest flat against the clamp surface 13 and/or the compensating surface 27. Preferably, the free end piece 15*c* of the snap-in pins 9 is bent in such a way that it rests parallel against the clamp surface 13. Especially advantageous is a design in which the free end piece 15*c* of the snap-in pins 9 is bent in such a way that it rests against the clamp surface 13 and is bent from there toward its free end or is bent toward the front as seen from the connector housing 2. In this connection, the free end piece 15*c* of the end section 15 is angled in the direction of the clamp surface 13, resting on it and being again bent away from the clamp surface 13.

FIGS. 6A to 6C show an example of the process of connecting the connector housing 2 with the connector plug 1. FIG. 6 A shows the state when the connector housing 2 and the connector plug 1 are plugged into each other, with the sliding sleeve 11 being in the default position. The indent 24 accommodates the end section 15 of the snap-in pins 9 in such a way that it preferably is just short of resting on the compensating surface 27. When the sliding sleeve 11 is moved toward the front, the sloping wall of the indent 24 puts pressure on the end section 15 of the snap-in pins 9 in such a way in the radial direction that the end section 15 comes to rest against the compensating surface 27 and presses against it as shown in FIG. 6B. In the process, a radial force $F_r$ acting from the wall 25 of the sliding sleeve 11 on the outer circumference of the end section 15 is exerted on the compensating surface. Moving the sliding sleeve further into another default position ultimately results in the connection of the connector housing 2 and the connector plug 1 according to FIG. 6C.

A comparison of FIG. 5 and 6 shows the advantageous snake-shaped design of the snap-in pins 9 with a part, 12 and 12*a*, that first widens and then narrows, allowing the snap-in pins 9 to stretch according to FIG. 6 when switching to the operating position, which ultimately facilitates an advantageously wide return of the last end piece 15*c* of the end section 15 backward to the clamp surface 13, wherein the part 15*b* angled or bent to increase the axial force component $F_a$ relative to the radial force component $F_r$ can be moved to the longitudinal axis A at an advantageously small angle. Of particular preference here is an embodiment in which the bent part 15*b* extends parallel to the compensating surface, with the radial force component $F_r$ being reduced to zero.

Because all radial force components $F_r$ are compensated on the compensating surface 27, only an axial force component $F_a$ is exerted against the clamp surface 13 even if the clamp surface 13 is inclined relative to the longitudinal axis A of the mating plug 14.

FIG. 8 shows a perspective view of the clamp sleeve designed with a multitude of individual snap-in pins 9 that clamp the inserted mating plug 14 before the connector plug, preferably parallel to the axis.

REFERENCE LIST

1 Connector plug
2 Connector housing
2*a* Counter stop on the back of the connector housing
2*b* Insert opening on the connector housing
3 Canal
4 Interior conductor contact
5 Insulator
6 Outer surface contact area
7 Front-end housing opening
8 Clamp sleeve

9 Snap-in pins
10 Axial slits
11 Sliding sleeve
12 Section of the snap-in pins radially widened outward
12*a* Section of the snap-in pins radially narrowing inward
13 Clamp surface
14 Mating plug
15 End section of the snap-in pins
15*a* Part of the end section extending outside
15*b* Part of the end section that is angled or bent
15*c* Last end piece of the end section
15*d* Radially outermost part of the end section
15*e* Lateral lug of the end section
15*f* Buckle line of the end section
16 Housing
17 Outer conductor contact area
18 Canal
19 Conductor
20 Insulator
21 Socket
22 Ridge
23 Front end
24 Indent
25 Internal circumference
26 Radially narrowing axial section of the indents 24
27 Compensating surface
28 Edge
29 Opposing surface
80 Back section of the clamp sleeve
81 Indent in the back section of the clamp sleeve
82 Lug in the back section of the clamp sleeve
83 Stop pin at the clamp sleeve
$F_r$ Radial force
$F_a$ Axial force component
$F_a^1$ Counterforce to the axial force component
$F_r$ Radial force component
$F_r^1$ Counterforce to the radial force component
A Longitudinal axis

The invention claimed is:

1. Coaxial connector plug (1) and mating plug (14)
in which the connector plug has a connector housing (2) that is open at the front end for plugging in or attaching the mating plug and is traversed by a canal (3) containing an insulated internal conductor contact (4), and
in which a clamp sleeve (8) and a sliding sleeve (11) can be moved axially to mechanically connect the connector housing with the mating plug,
in which the sliding sleeve surrounds the clamp sleeve in the operating position and exerts on it a force directed radially inward in the operating position,
in which a clamp sleeve can be made to rest against the mating plug at a clamp surface (13), and
wherein an outer conductor contact surface (17) of the mating plug can be clamped axially against an outer conductor contact surface (6) of the connector plug,
characterized by the fact that
the clamp sleeve (8) has an end section (15) with a section (15*a*) extending diagonally outward followed by a section (15*b*) extending diagonally inward and backward, wherein in the operating position an axial force component ($F_a$) is applied via the backward extending section (15*b*) from the clamp sleeve (8) to the clamp surface (13) and
the clamp sleeve (8) between the connector plug and the end section (15) has an area that first widens (12) and then narrows (12*a*).

2. Coaxial connector plug and mating plug according to claim 1,
characterized by the fact that
the widening part (12) and the narrowing (12*a*) part of the clamp sleeve (8) are designed elastically with spring activation that allows them to stretch temporarily in the axial direction (A) when moving from the stand-by position to the operating position.

3. Coaxial connector plug and mating plug according to one of the previous claims,
characterized by the fact that
the widening part (12) and/or the narrowing part (12*a*) between the connector plug and the end section (15) are designed in the form of snap-in pins (9) narrowing diagonally to the longitudinal extension.

4. Coaxial connector plug and mating plug according to one of the previous claims,
characterized by the fact that
the backward extending part (15*b*) of the end section (15) runs either parallel or at an acute angle diagonally backward to the clamp surface (13).

5. Coaxial connector plug and mating plug according to one of the previous claims,
characterized by the fact that
the clamp surface (13) extends either perpendicular or at an inclination to the outside and to the mating plug.

6. Coaxial connector plug and mating plug according to one of the previous claims,
characterized by the fact that
it has lugs on the clamp sleeve (8) opposite the end section (15) that are bent in the radial direction and act as a rear stop for the connector housing (2) of the connector plug (1).

7. Coaxial connector plug and mating plug according to one of the previous claims,
characterized by the fact that
the force ($F_R$) applied to the clamp sleeve (8) in the operating position is converted by the clamp sleeve (8) to an axial force component ($F_a$) that is exerted directly by the clamp sleeve (8) on the clamp surface (13).

8. Coaxial connector plug and mating plug according to claim 1,
characterized by the fact that
a radial force component ($F_r$) is exerted by the clamp sleeve (8) directly on a compensating surface (27) of the mating plug (15).

9. Coaxial connector plug and mating plug according to one of the previous claims,
characterized by the fact that
the axial force component ($F_a$) is exerted by the clamp sleeve (8) on the clamp surface (13) and/or the radial force component ($F_r$) is exerted on the compensating surface only when the sliding sleeve is moved to the operating position.

10. Coaxial connector plug and mating plug according to one of the previous claims,
characterized by the fact that
the clamp sleeve (8) can only be brought to rest against the clamp surface (13) by moving the sliding sleeve (11) into the operating position.

11. Coaxial connector plug and mating plug according to one of the previous claims,
characterized by the fact that
the clamp surface (13) extends perpendicular to the longitudinal axis (A) of the mating plug (14).

12. Coaxial connector plug and mating plug according to one of the previous claims, characterized by the fact that the compensating surface (27) extends parallel to the longitudinal axis (A) of the mating plug (14).

13. Coaxial connector plug and mating plug according to one of the previous claims, characterized by the fact that the clamp surface (13) is located on a ridge (22) of the mating plug (14) protruding radially outward and/or an indent of the mating plug (14) pointing radially inward.

14. Coaxial connector plug and mating plug according to one of the previous claims, characterized by the fact that the clamp surface (13) and/or the compensating surface (27) is designed to surround the mating plug (14).

15. Coaxial connector plug and mating plug according to one of the previous claims, characterized by the fact that the clamp sleeve (8) is designed in such a way that it extends axially past the clamp surface (13) and that the end part (15) is angled or bent in the direction of the clamp surface (13) or that the end part (15), angled in the direction of the clamp surface (13), rests against it and is again bent away from the clamp surface (13).

16. Coaxial connector plug and mating plug according to one of the previous claims, characterized by the fact that the clamp sleeve (8) has a part (12) extending radially outward, preferably immediately next to the end part (15).

17. Coaxial connector plug and mating plug according to one of the previous claims, characterized by the fact that the clamp sleeve (8) has axially extending slits (10).

18. Coaxial connector plug and mating plug according to one of the previous claims, characterized by the fact that the sliding sleeve (11) surrounds the clamp sleeve (8), even in the stand-by mode, during which the clamp sleeve (8) exerts no axial force component ($F_a$) on the clamp surface (13).

19. Coaxial connector plug and mating plug according to one of the previous claims, characterized by the fact that the clamp sleeve (8) fits with its radially outermost, in particular its front-end area, into an indent (26) on the inner circumference (25) of the sliding sleeve (11).

20. Clamp sleeve to rig a coaxial connector plug (1) and a mating plug (2) according to one of the previous claims, characterized by the fact that the clamp sleeve (8) has an end section (15) with a first part (15*a*) extending diagonally outward, followed by a second part (15*b*) extending diagonally inward and backward, wherein an axial force component ($F_a$) is exerted in the operating position by the clamp sleeve (8) on the clamp surface (13) via the part (15*b*) extending backward and the clamp sleeve (8) has a widening part (12) between the connector plug and the end section (15) followed by a narrowing part (12*a*).

21. Coaxial connector plug and mating plug according to one of the previous claims, characterized by the fact that the end section (15) of the clamp sleeve (8) is designed as a snap-in pin with a spherical or spoon-shaped contact head.

22. Coaxial connector plug and mating plug according to claim 21, characterized by the fact that the contact head is widened by lateral lugs (15*e*) in relation to the normal width of the snap-in pin (9).

23. Coaxial connector plug and mating plug according to one of the claims 21 or 22, characterized by the fact that the contact head extends to the full radius of the part (15*a*) extending outward and the part (15*b*) of the end section (15) extending diagonally inward and backward.

24. Coaxial connector plug and mating plug according to one of the claims 21 to 23, characterized by the fact that the contact head of the end section (15) forms a crease and buckle line (15*f*) on the inside of the end section (15).

* * * * *

UNITED STATES PATENT AND TRADEMARK OFFICE

CERTIFICATE OF CORRECTION

PATENT NO. : 7,238,047 B2
APPLICATION NO. : 11/488125
DATED : July 3, 2007
INVENTOR(S) : Saettele et al.

It is certified that error appears in the above-identified patent and that said Letters Patent is hereby corrected as shown below:

Claim 3, Column 10, Lines 9 to 11,
Please delete "according to one of the previous claims, characterized"
and
replace with
-- according to claim 1, characterized --

Claim 4, Column 10, Lines 16 to 18,
Please delete "according to one of the previous claims, characterized"
and
replace with
-- according to claim 1, characterized --

Claim 5, Column 10, Lines 22 to 24,
Please delete "according to one of the previous claims, characterized"
and
replace with
-- according to claim 1, characterized --

Claim 6, Column 10, Lines 27 to 29,
Please delete "according to one of the previous claims, characterized"
and
replace with
-- according to claim 1, characterized --

Claim 7, Column 10, Lines 34 to 36,
Please delete "according to one of the previous claims, characterized"
and
replace with
-- according to claim 1, characterized --

Claim 9, Column 10, Lines 47 to 49,
Please delete "according to one of the previous claims, characterized"
and
replace with
-- according to claim 1, characterized --

UNITED STATES PATENT AND TRADEMARK OFFICE

CERTIFICATE OF CORRECTION

PATENT NO. : 7,238,047 B2
APPLICATION NO. : 11/488125
DATED : July 3, 2007
INVENTOR(S) : Saettele et al.

It is certified that error appears in the above-identified patent and that said Letters Patent is hereby corrected as shown below:

Claim 10, Column 10, Lines 55 to 57,
Please delete "according to one of the previous claims, characterized"
and
replace with
-- according to claim 1, characterized --

Claim 11, Column 10, Lines 61 to 63,
Please delete "according to one of the previous claims, characterized"
and
replace with
-- according to claim 1, characterized --

Claim 12, Column 11, Lines 1 to 3,
Please delete "according to one of the previous claims, characterized"
and
replace with
-- according to claim 1, characterized --

Claim 13, Column 11, Lines 6 to 8,
Please delete "according to one of the previous claims, characterized"
and
replace with
-- according to claim 1, characterized --

Claim 14, Column 11, Lines 12 to 14,
Please delete "according to one of the previous claims, characterized"
and
replace with
-- according to claim 1, characterized --

Claim 15, Column 11, Lines 17 to 19,
Please delete "according to one of the previous claims, characterized"
and
replace with
-- according to claim 1, characterized --

UNITED STATES PATENT AND TRADEMARK OFFICE

CERTIFICATE OF CORRECTION

PATENT NO. : 7,238,047 B2
APPLICATION NO. : 11/488125
DATED : July 3, 2007
INVENTOR(S) : Saettele et al.

It is certified that error appears in the above-identified patent and that said Letters Patent is hereby corrected as shown below:

Claim 16, Column 11, Lines 26 to 28,
Please delete "according to one of the previous claims, characterized"
and
replace with
-- according to claim 1, characterized --

Claim 17, Column 11, Lines 32 to 34,
Please delete "according to one of the previous claims, characterized"
and
replace with
-- according to claim 1, characterized --

Claim 18, Column 11, Lines 36 to 38,
Please delete "according to one of the previous claims, characterized"
and
replace with
-- according to claim 1, characterized --

Claim 19, Columns 11, Lines 43 to 44 and Column 12, Line 1,
Please delete "according to one of the previous claims, characterized"
and
replace with
-- according to claim 1, characterized --

Claim 20, Column 12, Lines 5 to 7,
Please delete "according to one of the previous claims, characterized"
and
replace with
-- according to claim 1, characterized --

Claim 21, Column 12, Lines 18 to 20,
Please delete "according to one of the previous claims, characterized"
and
replace with
-- according to claim 1, characterized --

UNITED STATES PATENT AND TRADEMARK OFFICE

CERTIFICATE OF CORRECTION

PATENT NO. : 7,238,047 B2
APPLICATION NO. : 11/488125
DATED : July 3, 2007
INVENTOR(S) : Saettele et al.

It is certified that error appears in the above-identified patent and that said Letters Patent is hereby corrected as shown below:

Claim 23, Column 12, Lines 29 to 31,
Please delete "according to one of the claims 21 or 22, characterized"
and
replace with
-- according to claim 21, characterized --

Claim 24, Column 12, Lines 35 to 37,
Please delete "according to one of the claims 21 to 23, characterized"
and
replace with
-- according to claim 21, characterized --

Signed and Sealed this

Twenty-fifth Day of March, 2008

JON W. DUDAS
*Director of the United States Patent and Trademark Office*